United States Patent [19]

Queener

[11] 4,436,409

[45] Mar. 13, 1984

[54] FILE COMPACTION APPARATUS AND METHOD FOR COPIERS

[75] Inventor: Carl A. Queener, Lyons, Colo.

[73] Assignee: International Business Machines Corporation, Armonk, N.Y.

[21] Appl. No.: 335,932

[22] Filed: Dec. 30, 1981

[51] Int. Cl.[3] ..... G03G 15/00

[52] U.S. Cl. ..... 355/14 R; 355/7; 355/55; 355/77

[58] Field of Search ..... 355/14 R, 24, 23, 26, 355/55–57, 3 SH, 7, 53, 54, 77

[56] References Cited

U.S. PATENT DOCUMENTS

| | | | |
|---|---|---|---|
| 3,390,608 | 7/1968 | Jonker et al. | 88/24 |
| 3,590,712 | 7/1971 | Ataka | 95/36 |
| 3,972,610 | 8/1976 | Gross | 355/7 |
| 4,106,870 | 8/1978 | Kondo et al. | 355/4 |
| 4,334,765 | 6/1982 | Clark | 355/24 X |

FOREIGN PATENT DOCUMENTS

| | | |
|---|---|---|
| 29953 | 10/1981 | European Pat. Off. . |
| 2631920 | 3/1977 | Fed. Rep. of Germany . |

OTHER PUBLICATIONS

Patent Abstracts of Japan, vol. 43, Feb. 2, 1980, p. 115P5, Entitled "Copying Machine" by Tamaki Kaneko, Japan 55-15146.

IBM Series III Copier/Duplicator Model 10 and Model 20 Key Operator Instructions, Copyright 1976, pp. 4, 47–50 and 53–55.

*Primary Examiner*—Richard L. Moses

*Attorney, Agent, or Firm*—Earl C. Hancock

[57] ABSTRACT

Original document images are reduced to half-size or smaller and introduced to a photoconductor surface in a xerographic copier environment. Sequential images are oriented relative to a copy sheet so that two or more images are transferred to the copy sheet in a matrix pattern. Duplexing of the copy sheet allows recording of a double matrix on one copy sheet.

17 Claims, 3 Drawing Figures

FILE COMPACTION APPARATUS AND METHOD FOR COPIERS

BACKGROUND OF THE INVENTION

1. Field of the Invention

The present invention relates generally to xerographic copier methods and apparatus. More particularly, the present invention relates to methods and apparatus for copying original documents by selective discharge of a charged photoconductor to form a latent image and transfer of the latent image to a copy sheet which ultimately is processed to produce a visible copy of the original image. The present invention is compatible with contemporary xerographic copiers as either an add-on feature thereof or as a stand-alone copier. The present invention relates to methods and apparatus for producing multiple reduced images of original documents or the like on a single side of a copy sheet using xerographic techniques.

2. Description of the Prior Art

A significant problem in the typical office is the proliferation of information on paper and the attendant proliferation of the files needed to store that information. Development of microfiche and microfilm technologies has reduced the storage problems associated with this proliferation. While microfiche and microfilm devices achieve significant file compaction, it has only achieved limited acceptance and success in the everyday office environment. Part of the reason for this is that specialized equipment for recording and viewing is required while such equipment is generally expensive and seldom located conveniently to the typical user. Additionally the media which is usually silver halide film is expensive and generally unusable without the special magnification or viewing equipment. A relatively large number of documents are recordable on a single microfiche or microfilm but, because of the specialized recording equipment needed, the cost of such equipment and the general inconvenience of its use, recording by such devices is generally relegated to periodic processing of large batches of documents.

Xerographic copiers have developed to the point where they are now commonplace in even relatively small office environments. Such copiers frequently include image reduction structure which, in some cases, permits concurrently recording two documents in reduced size on a single side of a sheet. Such copiers also frequently include duplexing capability which allows recording reduced double copies on the opposite side so that recordation of up to four documents on a single copy sheet is possible. This is particularly attractive where the copier is capable of using plain paper copy sheets. Thus it is possible with contemporary copier devices to realize a four to one reduction in stored document volume.

While many contemporary copiers include automatic, semiautomatic and/or recirculating original document feeders, no known prior art device allows xerographic recording of multiple sequential original document images on the common surface of a single copy sheet.

DISCLOSURE OF THE INVENTION

The present invention is a xerographic copier method and apparatus wherein original document pages are exposable one at a time and reduced onto output copy paper such that each page of the final output copy paper contains a plurality of reduced images representing a plurality of original documents. The present invention is particularly well suited for adaptation to an existing copier environment and is susceptible to varying stages of automated usage. The present invention is adaptable for copying on both sides of each page of the output copy paper so that the thus duplexed output copy contains an increased number of reduced images of a plurality of originals. File compaction in accordance with the present invention is well suited for operator selection on a machine capable of functioning as a conventional office copier in addition to providing the alternative file compaction function.

The apparatus and method of the present invention is useful in a device having a photosensitive surface for electrostatically recording images where that device includes a conventional arrangement for synchronously moving copy sheets relative to the photosensitive surface for transferring images corresponding to the electrostatically recorded images to a copy sheet at a transfer station. The present invention is an improved apparatus and method for recording a plurality of original document images on a single copy sheet which includes original document image producing means for producing a light image at the photosensitive surface with this light image being no greater than half the size of the surface area of the copy sheet. The present invention further includes means controlling the orientation of the light image on the photosensitive surface with respect to the synchronous movement of the copy sheet for causing the light images corresponding to sequential original document images to be transferred to the copy sheet on separate portions of the surface area thereof.

The copy sheet is recirculatable though the transfer station for allowing sequential transfer thereto of the multiple light images. If desired, the copy sheet containing the light images is fusible prior to recirculation after each transfer.

In its preferred embodiment, the present invention includes the use of a reduction lens with a controller to cause relative movement between the lens and the location of the original document images subsequent to production of at least one of the light images at the photosensitive surface for producing sequential such light images on the photosensitive surface corresponding to sequential portions of the copy sheet surface area.

Yet another feature of the present invention is that it is possible to arrange the controls to selectively command initiation of image production at the photosensitive surface at a location other than the first location of the normal sequence.

The sequences of multiple image areas produced on the copy sheet is controllable by timing techniques and/or physical lateral displacement of the reduction lens. Further, duplexing of the copy sheet after the first side is fully imaged allows doubling of the number of originals retained on the copy sheet.

While the present invention is not necessarily limited thereto, it is particularly advantageous to use a three-to-one reduction lens so that nine reduced images are recordable on each side of the copy sheet. This particular reduction number is especially useful since the original documents reduced to $\frac{1}{3}$ original size are in many cases still reasonably readable to the human eye. Additional multiples of reduction allow greater numbers of fractional area recordings on each surface of the copy sheet (e.g.: four-to-one provides 16 copies per side, etc.) and for many of such magnification levels the original document is readable with the assistance of relatively inexpensive equipment such as a magnifying glass.

Those having normal skill in the art will readily recognize the foregoing and other objects, features, advantages and applications of the present invention in the light of the following, more detailed description of the exemplary preferred embodiments as illustrated in the accompanying drawings.

DETAILED DESCRIPTION OF THE PREFERRED EMBODIMENT

Figure 1:
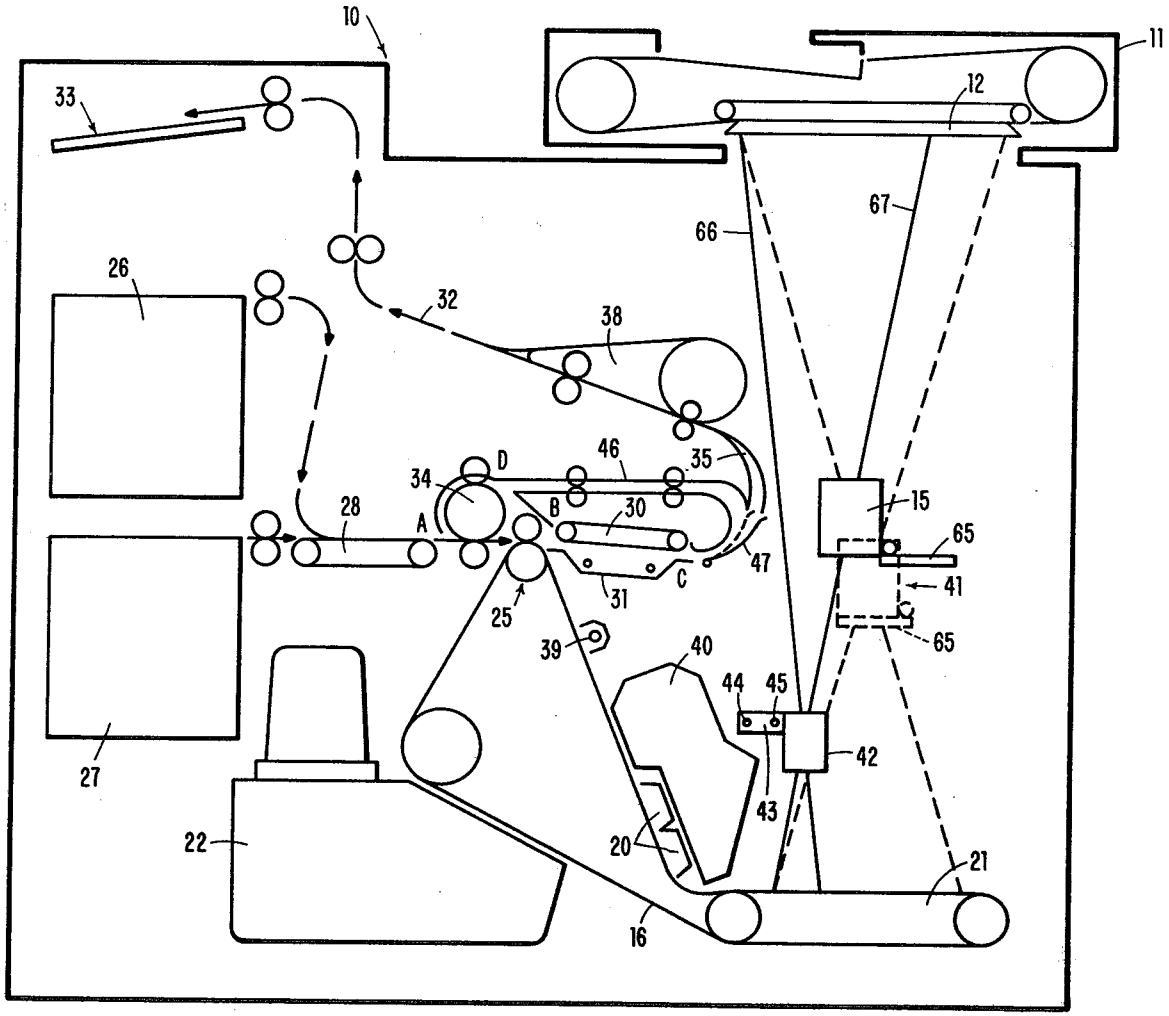
FIG. 1 is a somewhat schematic view of a typical contemporary copier with elements of the present invention incorporated therein.

FIG. 1 shows a schematic arrangement of a xerographic copier 10 incorporating the present invention. One or more original documents are placed on the input tray of recirculating automatic document feed 11 which moves the documents sequentially against a left edge reference on transparent platen 12. The documents on platen 12 are illuminated by a flash lamp arrangement (not shown) and the image is transferred by conventional lens 15 onto photoconductor belt 16. Belt 16 is appropriately charged by corona assembly 20 prior to arrival at the imaging location on vacuum transport table 21. Belt 16 is then driven past developer 22 where toner converts the latent image into a visible image on belt 16 and is thence moved to transfer station 25.

Copy sheets are extracted with a side edge leading from either bin 26 or 27 for transport over copy sheet input vacuum transport 28 into the transfer station 25. The copy sheets with the image thereon are withdrawn from transfer station 25 for exposure to flash fuser 31 where the toner representing the image is fused onto the copy sheet. The copy sheet is thereafter either passed through output paper path 32 into exit pocket 33 or returned for duplex coying by the appropriate gating around roller 34 so as to follow path C-B-D-A for image transfer to the opposite side. A document reversal mechanism 38 provides flipping of the documents to produce a correct order copy in exit tray 33.

The photoconductor belt 16, after the transfer station 25, is erased by an erase lamp 39 which is a segmented light-emitting diode array and the residual toner is removed by cleaner 40. The conventional lens is movable by means not shown to the dashed position of 41 for image reduction. The copier and its operation thus far described, is conventional and represents a typical example of implementation environment for the present invention, although the present invention is not limited to the specific xerographic apparatus shown and described.

Copier 10 is shown modified to accommodate one exemplary embodiment of the present invention for an operator selectable feature. A separate reduction lens 42 in mounting carriage 43 runs on threaded rails 44 and 45 for appropriate positioning as is described subsequently. Also, paper path 46 including a selectively pivotable intersecting gate 47 is included to provide an additional return paper path from C to D to accommodate the file compaction feature. Strategically positioned paper driving roller pairs are located in return path 46 as well as in exit path 32.

Figure 2:
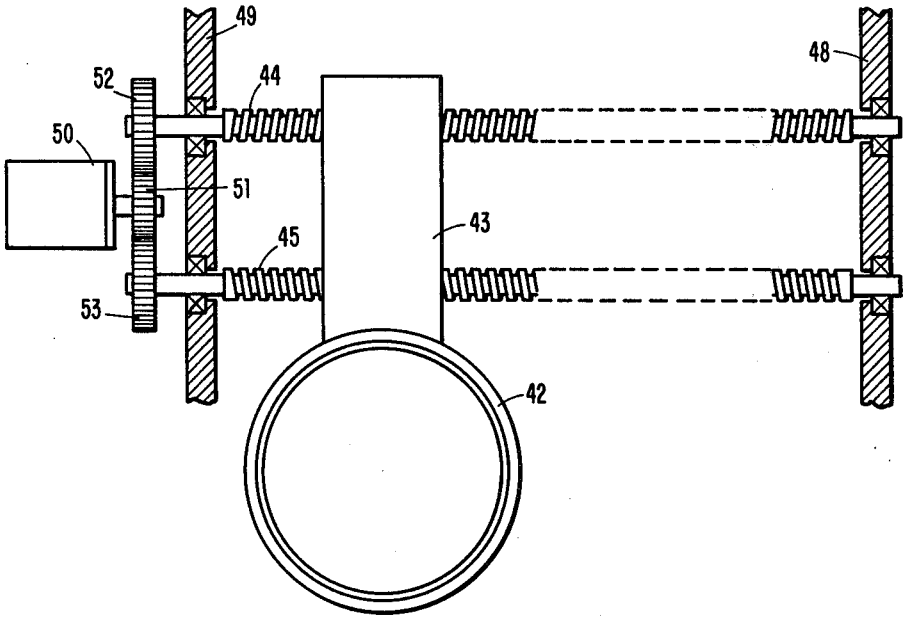
FIG. 2 is a top, partially broken and sectioned view of a file compaction reduction lens carriage drive configuration.

An example of a mounting arrangement for lens 42 is shown in greater detail in FIG. 2. Elongated, threaded mounting shafts 44 and 45 are suitably retained by bearings relative to side walls 48 and 49 of the base machine. Bidirectional drive motor 50 is coupled through gears 51–53 to shafts 44 and 45 which are oppositely threaded. Carriage 43 includes internal threaded portions or nuts (not shown) to appropriately engage the respective threads of shafts 44 and 45. Thus, as drive motor 50 rotates, carriage 43 moves toward either wall 48 or wall 49. When the file compaction feature is not in use, the special reduction lens 42 is parked out of the optical path of the conventional lens 15 in either normal or reduction mode by driving carriage 43 into a position in proximity to either wall 48 or 49.

Figure 3:
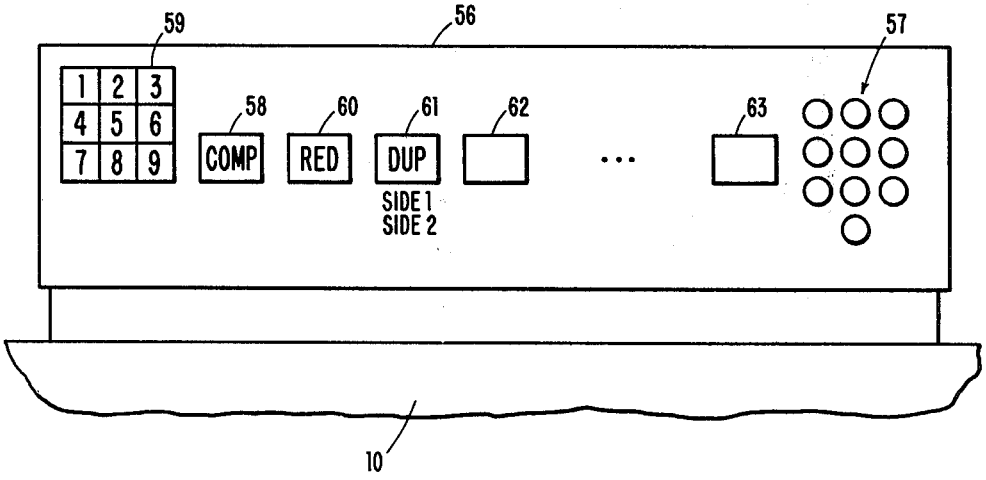
FIG. 3 is an illustration of an operator console for the FIG. 1 operation including the present invention.

Although not visible in FIG. 1, FIG. 3 shows a typical console 56 useful for copier 10 in conjunction with the present invention. Copier 10 includes appropriate controller arrangements such as microprocessors and the like with connections for monitoring the status of operator selectable buttons on console 56 and further with appropriate connections for controlling the operation of the copier 10 including its compaction feature in accordance with the programming stored in the microprocessor or computer. Although the computer and its interconnections are not shown, such devices are well known and their operation and interconnections are understood by those having normal skill in the art. The operator selects the file compaction mode by actuating COMP button 58 thereby activating the apparatus in accordance with the present invention.

File compaction button 58 is a multiple function button. That is, the controls respond to actuation of button 58 by selecting the file compaction mode and lighting button 58. Pressing button 58 after initiation of actual file compaction copying causes copy sheet ejection to exit pocket 33 and termination of the file compaction mode. Display 59, during file compaction copying, is backlit to indicate the particular position on the output copy sheet onto which the image is presently transferred. In essence, display 59 represents the pattern of the fractional areas of the copy sheet surface on which nine reduced images are recorded. By depressing compaction mode switch 58 and holding it depressed before the start of file compaction copying, the controls respond by moving the position on which the next copy is placed as reflected by panel 59. That is, the controls will sequence the backlit numbers on panel 59 from 1–9 and recycle this sequence until button 58 is released. Thus the operator can determine which position file compaction copying shall start.

Panel 56 contains other typical conventional buttons associated with the operation of copier 10 such as numeric keyboard input 57, reduction selection button 60, duplex operation 61 and one or more other buttons such as 62 and 63 for copy start, reset and other functions irrelevant to the present invention. An additional display is shown to indicate that the duplex operation is being performed on "SIDE 1" or "SIDE 2". Note that other types of displays are usable for the panel 59 function such as a single element, seven segment display. Further, by backlighting the numeric keys of keyboard 57, the function of display 59 is obtainable from panel 57 which permits omission of display 59 entirely.

After the compaction selection key 58 is enabled and the start button pressed, the machine logic moves conventional lens 15 to the reduction position 41 shown in FIG. 1 if it is not already there. In addition, a shutter 65 is moved across the aperture of lens 15 so that it will not image photoconductor belt 16. By moving lens 15 to reduction position 41, it is out of the normal imaging path for special reduction lens 42 as indicated by lines 66 and 67 thereby allowing lens 42 to produce a reduced image size on belt 16 without interference from lens 15. Of course other apparatus is available to mechanically move lens 15 out of the way.

Lens 42, in the example now described, is a three-to-one reduction lens which allows placement of nine images on a single side of a copy sheet in accordance with this invention. After the machine is selected for file compaction beginning with the first zone, motor 50 is turned on to move lens 42 in a direction transverse to the direction of movement of belt 16. That is, lens 42 is moved from the parked position to the first of the three possible positions in the X dimension (into the plane of the paper of FIG. 1). If the operator has selected a start at any of the fourth through sixth or seventh through ninth zones, as mentioned above, the controls move lens 42 to the respective second or third positions before initiating copying.

The first original of the stack is moved by feeder 11 into position on glass 12 and exposed onto the photoconductor belt 16. The position of the first three reduced images formed on belt 16 in the Y dimension (e.g.: horizontally along table 21 in FIG. 1) is controlled by the machine logic which in turn controls the timing of the firing of the xenon exposure lamp for the document on platen 12. The controls in a normal sequence after exposure of the first three documents for recording in the first three fractional area zones, move carriage 43 from the first to the second X dimension position. The first image on belt 16 is developed and transferred to a copy sheet at transfer station 25 and fused by fuser 31 in the normal fashion. However, after fusing, the copy sheet is recirculated along paper path 46. Meanwhile, the second original is positioned by the feeder 11 onto document glass 12 for exposure. The process is repeated without moving the special reduction lens 42, again the correct positioning of the reduced image on photoconductor belt 16 is obtained by appropriate timing as to when the flash exposure lamp is fired. Note that the copy sheets extracted from bins 26 or 27 are passed through the paper paths and the various operational station with the side edge first.

Accordingly, the normal operating sequence in this example is that, after the first three originals are copied in reduced size onto the same copy sheet and in sequential positions, the machine pauses briefly from the copying process while special reduction lens 42 is repositioned in the direction perpendicular to the drawing of FIG. 1 or to the right into the center position in FIG. 2. The process is then resumed with the fourth, fifth and sixth originals with the images thereof sequentially transferred onto the same copy sheet. Finally, special reduction lens 42 is moved to the third and last position and the process is repeated for reduced imaging for the seventh, eighth and ninth originals.

After the ninth original is copied in the above-described manner, the copy sheet is either delivered to exit tray 33 if the run is completed or, if not, it is routed by the machine logic along the paper path C-B-D-A which is a normal duplex path and the above-described process is repeated for the tenth through eighteenth originals. Subsequent to the eighteenth original copying in reduced format onto the common copy sheet, the copy sheet is delivered to exit pocket 33. The controls illuminate the "SIDE 1" or "SIDE 2" panel on console 56 so that the operator knows what position is in process in conjunction with the particular numeric element that is lit on display 59.

Experience has shown that reduction of three-to-one so that nine copies are on each side of a sheet produces copy which is still reasonably legible to the human eye for most typical correspondence and drawings. Note that the present invention offers the user update capability not available with conventional microfiche and the like. For example, assume only seven originals were copied onto the copy sheet initially. That same copy sheet is placed in the appropriate supply bin 26 or 27 and used by selecting compaction button 58 and holding button 58 down until the controller sequences up to the "eight" display on 59 at which point button 58 is released. Subsequent to this scrolling to the correct position, the file compaction controls initiate imaging on the eighth area and completion of that sheet with the ninth area followed by duplexing on the opposite side if additional copies are needed.

Figure 4:
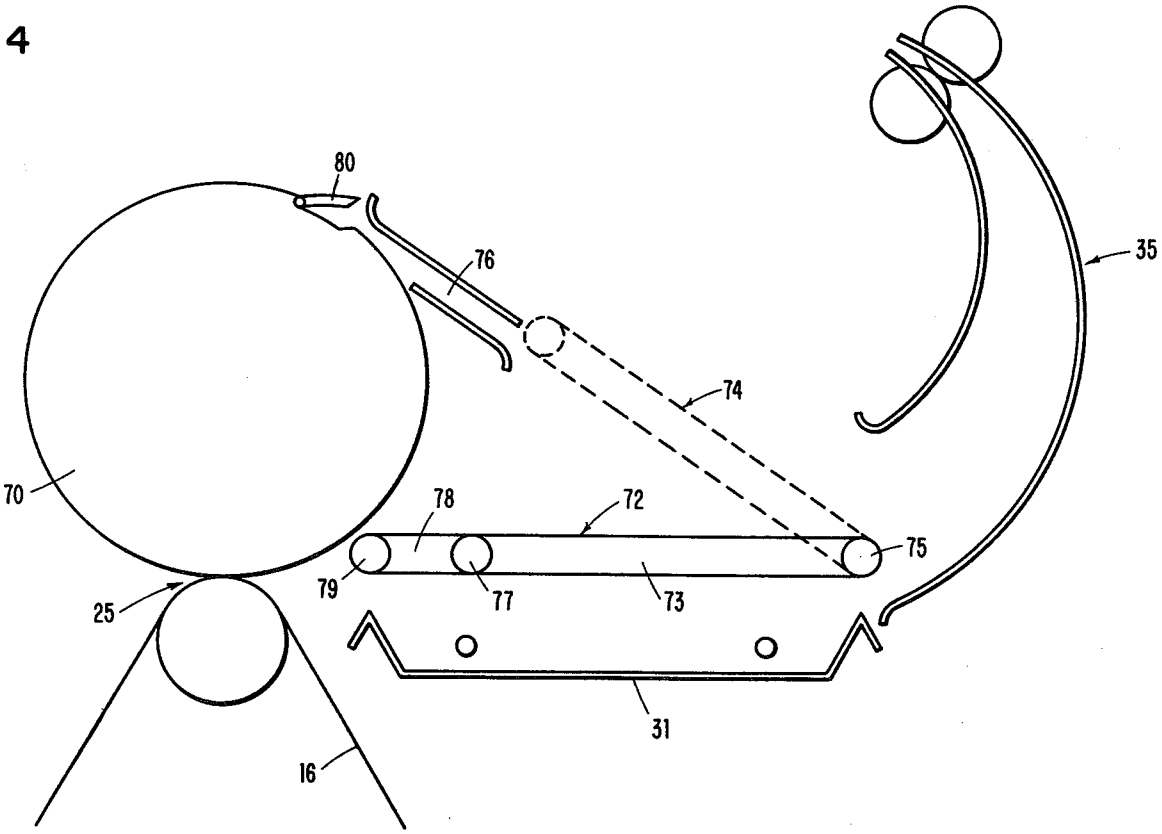
FIG. 4 illustrates schematically selected elements for possible inclusion as another modification of the FIG. 1 copier in accordance with the present invention.

FIG. 4 illustrates another form of of the preferred embodiment in accordance with the present invention. The embodiment as described for FIG. 1 successively passes the copy sheet through fuser 31 a multiplicity of times—once for each original copied onto the file-compacted output copy. In FIG. 4, the output copy sheet is retained on transfer roll 70 at the onset of the file compaction process. All images are accumulated on one side of the sheet before passing the sheet through the fuser 31. FIG. 4 shows a schematic of the transfer station 25 and fuser 31 region of the copier 10. For simplex, normal copying operations, the output sheets pass flash fuser 31 on the lower side of the vaccum belt transport assembly 72 after which they are introduced to the mouth 35 of exit path 32.

For duplex copying, after the first side of the output copy is fused, segment 73 of vacuum transport assembly 72 is pivoted to position 74 around vacuum belt drive roll 75. The belt movement direction is reversed to drive the sheet into guide 76 and thence into the open gripper bar 80 on biased transfer roll 70. Gripper bar 80 closes on the sheet leading edge and the sheet is run back through the transfer station 25 to produce the second side of the output copy. Segment 73 is pivoted back to its home position. As the leading edge of the sheet exits the transfer nip region of transfer station 25, gripper bar 80 releases this sheet and it is attached to segment 78 of vacuum transport assembly 72. The sheet is then conveyed on the lower side of the vacuum belts for segments 73 and 78 through fuser 31 and into the mouth 35 of the exit path.

When the file compaction mode of operation is selected, the blank copy sheet is passed through the paper path as if it were the second side of a duplex copy. That is, the sheet is clamped by gripper bar 80 onto the biased transfer roll 70 as previously described. However, gripper bar mechanism 80 does not release the output copy sheet until all the desired images are transferred to it. The output sheet remains clamped to bias transfer roll 70 and makes a multiplicity of passes through the transfer nip 25 until the reduced images of all originals desired on that side are transferred. The gripper bar then releases the sheet to pass through fuser 31. As in the previously described operation, the file compacted output sheet is duplexable to produce a plurality of reduced images on each side of the output sheet in substantially the same manner as described before. Note that vacuum transport assembly 72 is shown as a double segment configuration only to accommodate the large diameter of roll 70 needed to hold a complete document on its circumferential surface. This allows retention of the other elements and paper feed paths in FIG. 1 in their original orientation.

Vacuum transport segments 73 and 78 have interleaved belts and allow segment 73 to pivot without interference with the periphery of drum 70. The vacuum belts for segment 78 are either independently driven as through roller 79 or are coupled and uncoupled relative to segment 73 as at juncture 77 depending upon the position of segment 73.

Various arrangements for operation of gripper bar mechanism 80 are well known in the art. For instance, the April 1978 issue of the *IBM Technical Disclosure Bulletin* at pages 4702–4703 in the article entitled "Gripper/Ejector Mechanism" by R. V. Davidge, H. W. Simpson and R. D. Stroh describes an edge gripper easily adaptable for use in conjunction with the present invention by arranging its structure so that its central shaft rotates with the drum after the sheet is gripped but with the central shaft braked to release and eject the sheet at the end of a copy run.

The present invention is useful with manually fed copiers but is particularly well suited for file compaction operation in conjunction with an automatic document feeder whether or not of the recirculating variety. With such an automatic feature, the copier is loaded with an extensive stack of documents for compact recording and proceeds to automatically feed those documents sequentially to the imaging station where they are reduced and placed on the copy sheet until the copy sheet is full on both sides. The copy sheet is ejected to the exit pocket and the operation repeated for the next multiplicity of documents from the stack until the stack is depleted. The use of nine copies per side is described herein since it produces reasonably readable copies. Additional reduction is possible although magnification eventually becomes a requirement for reading of the documents. It is possible to operate copier 10 by cleaning and charging belt 16 followed by stopping and appropriate incrementing of belt 16 so that all fractional areas of belt 16 are imaged before transfer of the whole matrix to a copy sheet. Also, it is possible to retain lens 42 in one position and appropriately control the orientation of the copy sheet at the transfer station to realize image alignment on the sheet equivalent to the incremented movement of lens 42.

Note that reversal of a special lens such as 42 in its relative position to the document platen and the imaging table 21 allows return of the reduced segment on the copy sheet with compacted data to its normal size for production as an output copy. This requires either an additional special lens 42 or an elevator arrangement to reposition lens 42 and its movement carriage relative to the optical path between platen 12 and table 21. The invention is equally well suited for use with any copier environment including liquid developer types, coated paper copiers, drum-type copiers, roller-type fusers, copiers with collator output, single supply copiers, two-cycle copiers, moving document scanning copiers, moving optics scanning copiers, or the like.

Although the foregoing describes the exemplary preferred embodiments in relatively specific detail, those having normal skill in the art will recognize various changes, modifications, additions and applications other than those specifically mentioned herein without departing from the spirit of this invention.

What is claimed is:

1. In an apparatus having a photosensitive surface for electrostatically recording images and means synchronously moving copy sheets relative to the photosensitive surface for transferring images corresponding to the electrostatically recorded images to a copy sheet at a transfer station, an improvement for recording a plurality of original document images on a single copy sheet comprising:

original document image producing means for producing a light image at the photosensitive surface with said light image being no greater than half the size of the surface area of the copy sheet, means controlling the orientation of said light image on said photosensitive surface with respect to the synchronous movement of the copy sheet for causing said light images corresponding to sequential original document images to be transferred to the copy sheet on separate portions of the surface area thereof in a predetermined sequence, and means selectively operable for commanding said controlling means to initiate image production at the photosensitive surface at a location other than the first location of the predetermined sequence.

2. An improved apparatus in accordance with claim 1 wherein said controlling means includes means recirculating the copy sheet through said transfer station for receiving multiple said light images.

3. An improved apparatus in accordance with claim 2 which includes means fusing said light image on said copy sheet prior to operation of said recirculating means.

4. An improved apparatus in accordance with claim 1 wherein said original image producing means includes a reduction lens, and said controlling means includes means causing relative movement between said lens and the location of original document images subsequent to production of at least one of said light images at the photosensitive surface for producing sequential said light images on the photosensitive surface corresponding to sequential portions of the copy sheet surface area.

5. In an apparatus having a photoconductive surface for electrostatically recording images present at a scanning location and including means for applying a charge to said surface, means for moving copy sheets through an image transfer station synchronously with movement of the photoconductive surface for transferring the images to the copy sheet, an improvement comprising:

an image reducing lens, means movably mounting said lens between the scanning location and the photoconductive surface, and means controlling movement of said lens mounting means for sequentially imaging fractional areas of the photoconductor surface so that multiple images presented at the scanning location are transferred to corresponding sequential fractional areas of a copy sheet, said controlling means including timing means controlling exposure of the scanning location to the photoconductor surface for recording images in sequential fractional surface areas aligned with the direction of movement of said surface.

6. Apparatus in accordance with claim 5 wherein said controlling means includes means moving said lens in steps in a direction transverse to the direction of movement of the photoconductor surface.

7. Apparatus in accordance with claim 5 wherein said controlling means includes means moving said lens in steps in a direction transverse to the direction of photoconductor surface movement and shift control means for enabling said timing means to sequentially expose all fractional areas for each positioning of said lens by said step moving means.

8. Apparatus in accordance with claim 5 which includes means recirculating the copy sheet through the image transfer station for recording multiple images thereon.

9. Apparatus in accordance with claim 8 which includes means selectively operable for reversing the copy sheet side passed through the transfer station, and means responsive to recordation of images in all fractional surface areas of a first side of the copy sheet for enabling said reversing means.

10. Apparatus in accordance with claim 7 which includes:

means recirculating the copy sheet through the image transfer station for sequentially recording multiple images thereon, means selectively operable for reversing the copy sheet side passed through the transfer station by said recirculating means, and means responsive to imaging of the last fractional area of a first side of the copy sheet for enabling said reversing means.

11. Apparatus in accordance with claim 10 which includes means fusing the images on the copy sheet at least prior to operation of said reversing means.

12. Apparatus in accordance with claim 7 which includes means selectively operable for causing said controlling means to initiate imaging at a fractional area other than the first fractional area of a normal sequence.

13. The method of recording multiple images on a copy sheet in a copier having a scanning station and a moving photoconductor surface comprising the steps of:

sequentially exposing the photoconductor with images of originals having a size that is a fraction of the size of original images present at the scanning station, developing the images on the photoconductor surface, transferring the developed images from the photoconductor surface to sequential fractional areas of a copy sheet surface, fusing the developed images on the copy sheet, reversing the orientation of the copy sheet after all fractional areas of the first side have fused images thereon, and repeating said exposing, developing, transferring, and fusing steps for the second side of the copy sheet.

14. The method in accordance with claim 13 which includes the step of:

transferring the developed images to a fractional area of the copy sheet at a location subsequent to the first fractional area of a normal fractional area sequence.

15. In an apparatus having a photosensitive surface for electrostatically recording images and means synchronously moving copy sheets relative to the photosensitive surface for transferring images corresponding to the electrostatically recorded images to a copy sheet at a transfer station, an improvement for recording a plurality of original document images on a single copy sheet comprising:

original document image producing means for producing a light image at the photosensitive surface with said light image being no greater than half the size of the surface area of the copy sheet, means for recirculating the copy sheets through said transfer station, and means controlling the operation of said recirculating means and the orientation of said light image on said photosensitive surface with respect to the synchronous movement of the copy sheet for causing transfer of said light images corresponding to sequential original document images to the copy sheet on separate portions of the surface area thereof in a geometric sequence.

16. An improved apparatus in accordance with claim 15 wherein said recirculating means responds to said controlling means for recirculating the copy sheet through said transfer station until all areas of said geometric sequence have received respective light images.

17. An improved apparatus in accordance with claim 16 which includes means fusing each said light image on said copy sheet prior to recirculation thereof by said recirculating means.

* * * * *